US011050177B2

(12) United States Patent
Schaefer et al.

(10) Patent No.: US 11,050,177 B2
(45) Date of Patent: Jun. 29, 2021

(54) CONTACT ASSEMBLY

(71) Applicant: TE Connectivity Germany GmbH, Bensheim (DE)

(72) Inventors: Maik Schaefer, Gernsheim (DE); Helge Schmidt, Speyer (DE); Harald Kraenzlein, Schopfloch (DE)

(73) Assignee: TE Connectivity Germany GmbH, Bensheim (DE)

( * ) Notice: Subject to any disclaimer, the term of this patent is extended or adjusted under 35 U.S.C. 154(b) by 37 days.

(21) Appl. No.: 16/546,491

(22) Filed: Aug. 21, 2019

(65) Prior Publication Data

US 2020/0067223 A1 Feb. 27, 2020

(30) Foreign Application Priority Data

Aug. 22, 2018 (DE) ..... 102018214203.3

(51) Int. Cl.

| | |
|---|---|
| ***H01R 13/11*** | (2006.01) |
| ***H01R 24/20*** | (2011.01) |
| ***H01R 13/50*** | (2006.01) |
| ***H01R 101/00*** | (2006.01) |
| ***H01R 13/627*** | (2006.01) |

(52) U.S. Cl.

CPC ..... *H01R 13/113* (2013.01); *H01R 24/20* (2013.01); *H01R 13/50* (2013.01); *H01R 13/6272* (2013.01); *H01R 2101/00* (2013.01)

(58) Field of Classification Search

CPC .. H01R 13/113; H01R 13/50; H01R 13/6272; H01R 24/20; H01R 2101/00

See application file for complete search history.

(56) References Cited

U.S. PATENT DOCUMENTS

| | | | | |
|---|---|---|---|---|
| 5,342,226 | A | 8/1994 | Hayes et al. | |
| 2004/0040733 | A1* | 3/2004 | Yuasa | H01R 13/17 174/68.2 |
| 2012/0108113 | A1 | 5/2012 | Yamaguchi et al. | |
| 2014/0127954 | A1* | 5/2014 | Ando | H01R 13/113 439/884 |
| 2014/0273652 | A1* | 9/2014 | Szu | H01R 13/6585 439/660 |
| 2019/0157786 | A1 | 5/2019 | Horiuchi | |

FOREIGN PATENT DOCUMENTS

| | | | |
|---|---|---|---|
| EP | 2720322 | A1 | 4/2014 |
| JP | 2017204397 | A | 11/2017 |
| WO | 2013153089 | A2 | 10/2013 |

OTHER PUBLICATIONS

Extended European Search Report, dated Mar. 25, 2020, 8 pages.
Translation of JP 2017204397, dated Nov. 16, 2017, 8 pages.

* cited by examiner

*Primary Examiner* — Briggitte R. Hammond
(74) *Attorney, Agent, or Firm* — Barley Snyder

(57) ABSTRACT

A contact assembly for an electrical connector is provided and generally includes a plurality of first contact bodies and a plurality of second contact bodies. The plurality of first contact bodies include contact surfaces that provide a first contact plane. The plurality of second contact bodies include contact surfaces that provide a second contact plane that is spaced apart from and projecting beyond the first contact plane by a height. The plurality of second contact bodies are elastically deflectable to the first contact plane.

21 Claims, 3 Drawing Sheets

CONTACT ASSEMBLY

CROSS-REFERENCE TO RELATED APPLICATION

This application claims the benefit of the filing date under 35 U.S.C. § 119(a)-(d) of German Patent Application No. 102018214203.3, filed on Aug. 22, 2018.

FILED OF THE INVENTION

The invention relates to a contact assembly and, more particularly, to a contact assembly for an electrical connector.

BACKGROUND

Plug and socket connectors generally include contact assemblies to transmit electrical signals, for example. The plug connector includes a contact that is plugged into a plug receiving opening in the plug-in direction and bears on contact surfaces of the socket connector. In this case, the theoretical number of contact surfaces can be too small, as a result of which an insufficient electrical contacting is obtained. An increase in the number of contact surfaces can lead to the plug contact not being able to make uniform contact the contact surfaces of the socket.

Therefore, there is a need to provide a solution that enables a stable electrical and mechanical contacting between the plug and socket connector assembly.

SUMMARY

A contact assembly for an electrical connector is provided and generally includes a plurality of first contact bodies and a plurality of second contact bodies. The plurality of first contact bodies include contact surfaces that provide a first contact plane. The plurality of second contact bodies include contact surfaces that provide a second contact plane that is spaced apart from and projecting beyond the first contact plane by a height. The plurality of second contact bodies are elastically deflectable to the first contact plane.

BRIEF DESCRIPTION OF THE DRAWINGS

The invention will now be described by way of example with reference to the accompanying Figures, of which.

DETAILED DESCRIPTION OF THE EMBODIMENTS

Hereinafter, the invention is described in greater detail by way of example using exemplary embodiments with reference to the attached figures. In the figures, elements which correspond to one another in design and/or function are provided with the same reference symbols.

The combination of features shown and described with the individual exemplary embodiments serves solely the purposes of explanation. In accordance with the statements above, it is possible to dispense with a feature from an exemplary embodiment if its technical effect is of no importance in a particular application. Conversely, in accordance with the statements above, a further feature can be added in an exemplary embodiment if its technical effect is meant to be advantageous or necessary to a particular application.

Now with reference to FIGS. 1-4, a socket connector 1 according to the invention is shown. To aid comprehension, the description uses a Cartesian coordinate system, with a plug-in direction S, a transverse direction Q and a height direction H. The embodiments depicted in the figures are given merely by way of example and serve the purpose of explanation. Thus, a plug contact can also be provided with a contact assembly 3 according to the invention, for example.

Figure 1:
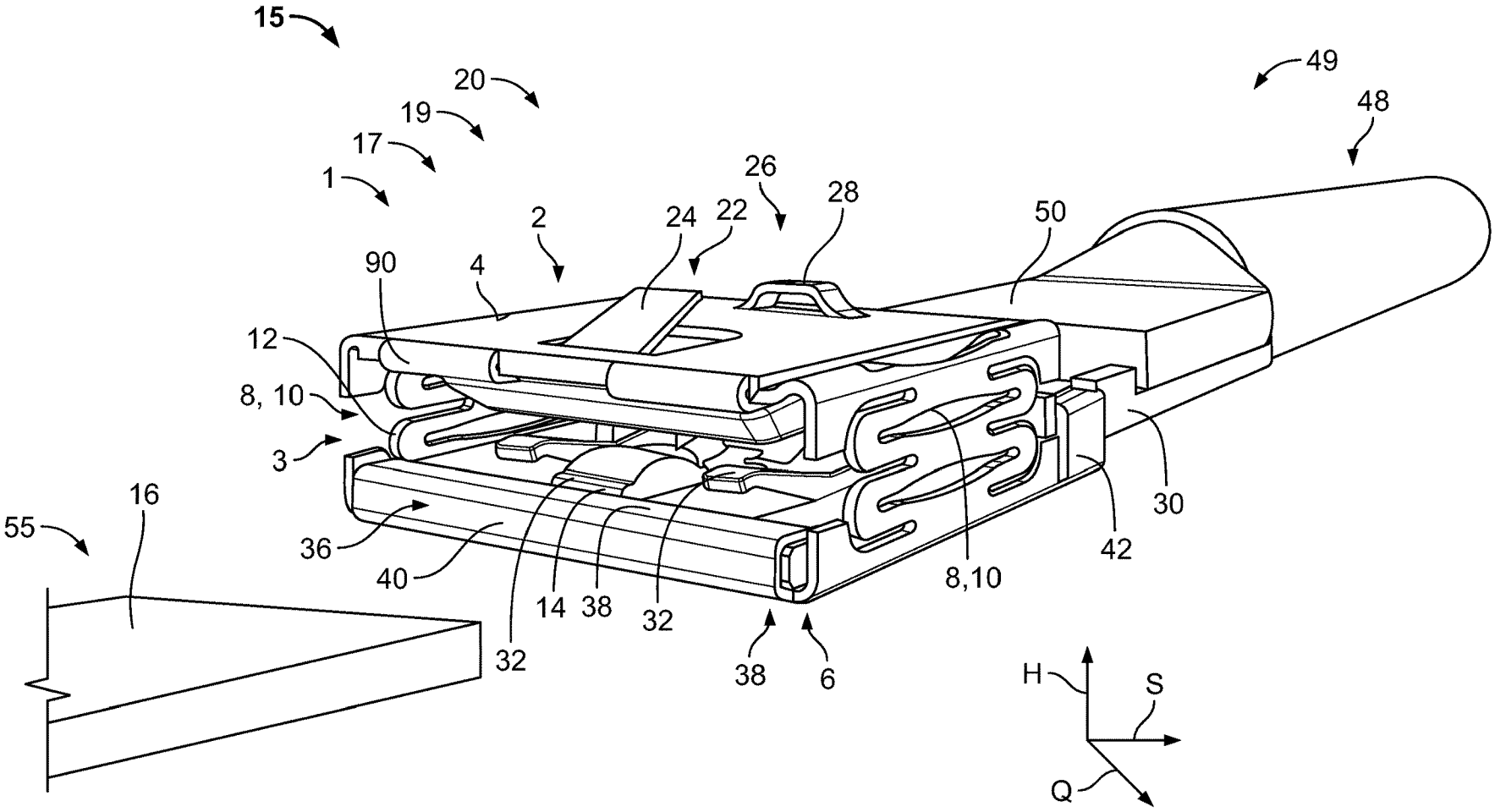
FIG. 1 shows a perspective view of a socket connector according to the invention.
Figure 2:
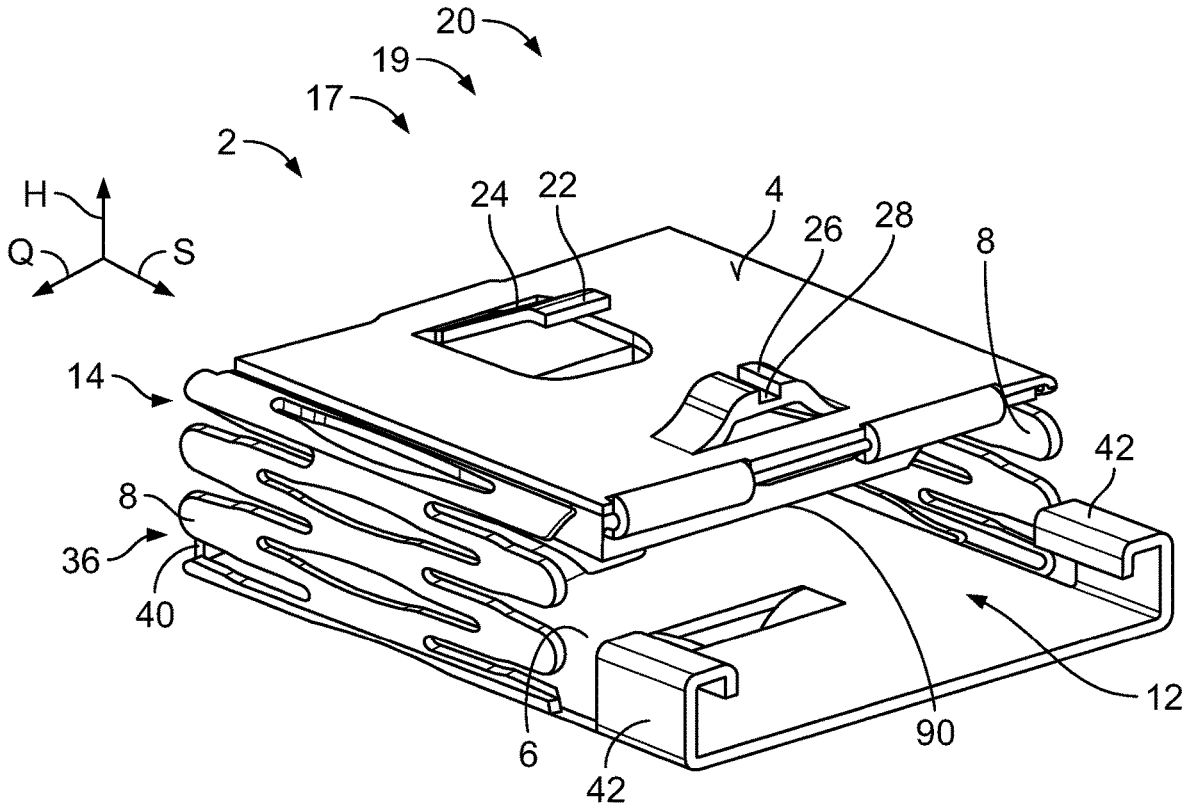
FIG. 2 shows a perspective view of a socket housing of a socket connector according to the invention.
Figure 4:
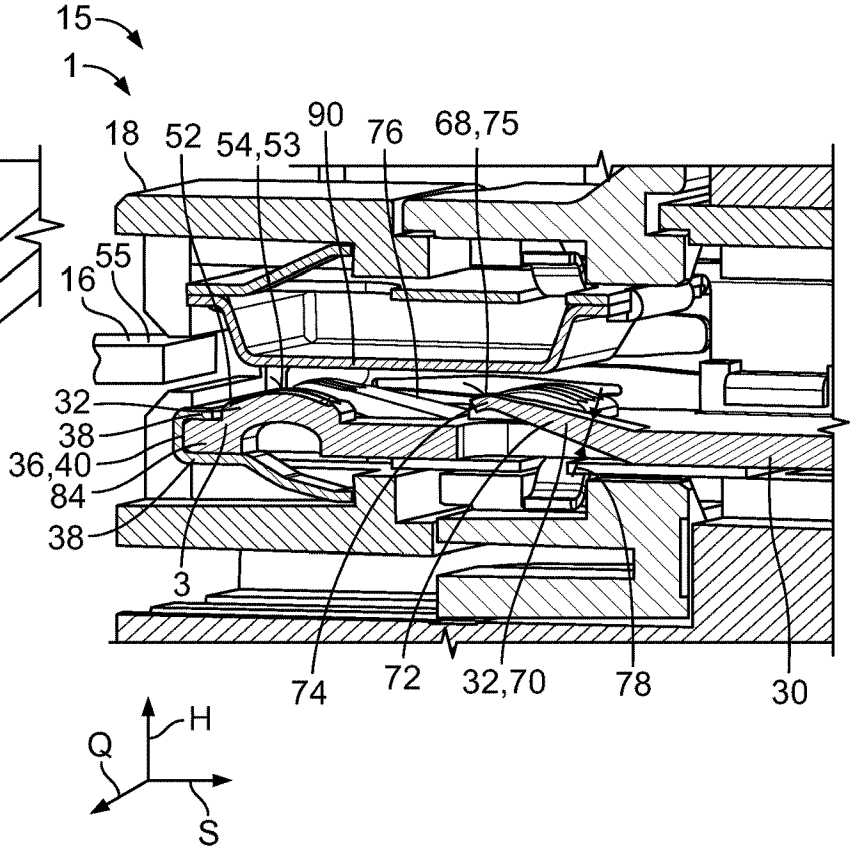
FIG. 4 shows a sectional view of a socket connector having contact assembly a according to the invention, showing a plug connector inserted therein.

FIG. 1 shows an exemplary embodiment of the socket connector 1. The socket connector 1 generally includes a socket housing 2, which has been formed from a metal sheet by stamping and bending and which is shown in FIG. 2 in a further schematic perspective view, and a contact assembly 3 according to the invention.

The socket housing 2 includes an upper side 4 and a lower side 6 which are spaced apart from one another in the height direction H. The upper side 4 and lower side 6 are connected to one another by side walls 8 which extend in the height direction H. The side walls 8 are formed by springs 10, which enables the upper side 4 to move relative to the lower side 6 along the height direction H. The socket housing 2 can be widened and/or compressed along the height direction H. The socket housing 2 surrounds a plug connector receiving space 12 which increases in the case of widening in the height direction H and decreases in the case of compression. A part of the plug connector receiving space 12 is formed by a plug receiving opening 14, into which a plug contact 16, schematically depicted in FIG. 1, can be plugged along the plug-in direction S into the socket housing 2. In particular, the insertion of the plug contact 16 can lead to the socket housing 2 and the plug receiving opening 14 being widened. A plug connector 15 according to the invention is likewise depicted in FIG. 1 and includes a plug contact 16 and a socket connector 1 according to the invention.

FIG. 1 shows a force-free state 17, which, in the example shown, is already a first widened position 19. By inserting the plug contact 16 into the plug receiving opening 14, the socket housing 2 and the plug receiving opening 14 can be widened further and cross over into a second widened position. By compression, for example by pressing together at the upper side 4 and lower side 6, the socket housing 2 can be compressed in the height direction H, so that it can be introduced into a housing 18 (not shown in greater detail in FIG. 1). Through compression, the socket housing 2 can cross over into a narrowed position. When the force is removed, the socket housing 2 can automatically cross over into the shown first widened position 19.

In an alternative configuration, the configuration in FIG. 1 can also correspond to a narrowed position 20 and the socket housing 2 can firstly be transferred into a widened position by plugging in the plug contact 16.

In the shown embodiment, the socket housing 2 has a first catch 22 with a lock 24 positioned along a front region thereof with respect to the plug-in direction S. Through the first catch 22, the socket housing 2, in a narrowed position, can be retained in a corresponding housing 18. The lock 24 may automatically lock in place when the socket housing 2 is inserted and thereby establishes a form-fit (see FIG. 4).

Furthermore, in a rear region in the plug-in direction S, the socket housing 2 possesses a second catch 26. The second catch 26 is configured to establish a form-fit with the housing 18 in a widened position. The second catch 26 is formed by a protrusion 28 which, in the embodiment shown, is attached to the upper side 4 and protrudes in the height direction H in relation to it.

The first catch 22 can establish, with the housing 16, a form-fit which acts in the plug-in direction S, the second catch 26 being able to establish, with the housing 16, a form-fit which acts counter to the plug-in direction S. The protrusion 28 and/or the lock 24 can be formed from the upper side 4 by stamping or embossing. Alternatively, or also additionally, a lock 24 and/or a protrusion 28 can be present on the lower side 6.

Figure 3:
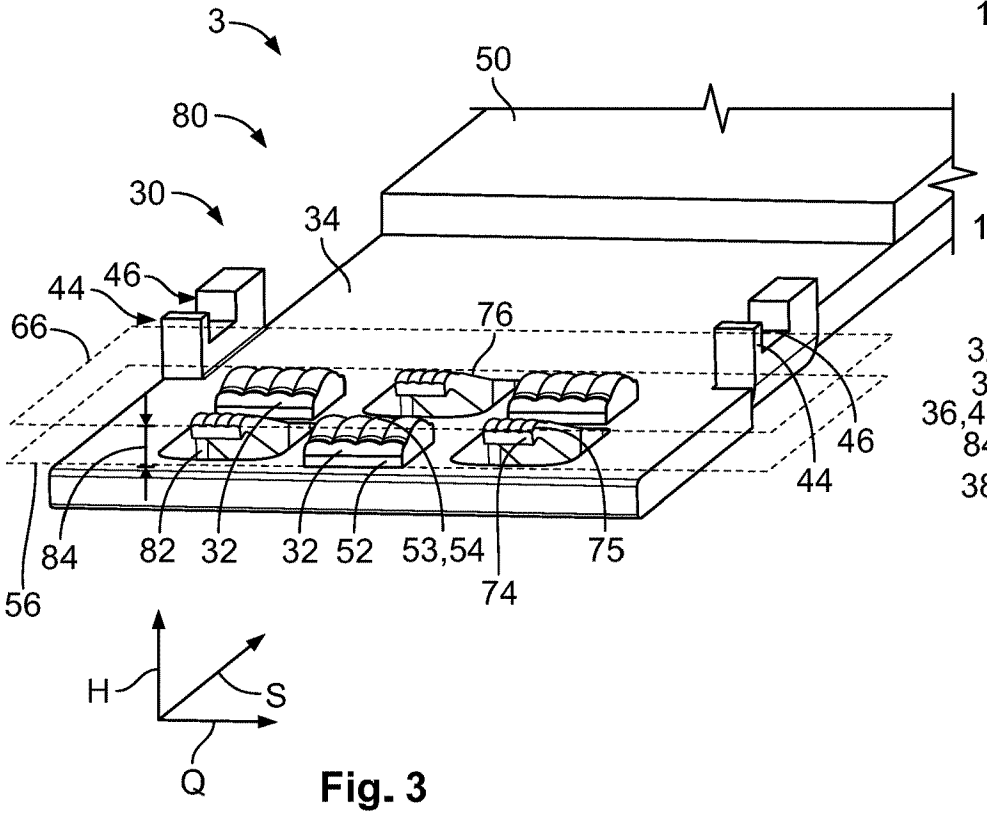
FIG. 3 shows a perspective view of a contact assembly according to the invention, with a base plate.

In addition to the socket housing 2 shown in FIG. 2, the socket connector 1 may include, by way of example, an embodiment of a contact assembly 3 according to the invention with a base plate 30 which is depicted in a schematic perspective view in FIG. 3. The base plate 30 is provided with several contact elements 32 which protrude from a surface 34 of the base plate 30 in the direction of the plug receiving opening 14.

The base plate 30 has a free end which can be plugged into the socket housing 2 against the plug-in direction S up to the stop, so that at least one section of the base plate 30 is placed in the socket housing 2 and the contact elements 32 project into the plug connector receiving space 12.

For this purpose, the socket housing 2 is provided at its end located to the front in the plug-in direction S with a receiving pocket 36 which has a substantially U-shaped cross-section with two legs 38 spaced apart from one another in the height direction H and a base 40 which connects the two legs 38 to one another in a plane parallel to a plane spanned by the plug-in direction S and height direction H. The free end of the base plate 30 can be introduced into the receiving pocket 36 against the plug-in direction S. In this case, the free end of the base plate 30 comes to a stop against the base 40 of the receiving pocket 36 and is encompassed by the legs 38. The receiving pocket 36 can be formed by bending, for example, one leg 38 being formed by the lower side 6 of the socket housing 2. The receiving pocket 36 is thus form-fit with the base plate 30 counter to the plug-in direction S.

The lower side 6 of the socket 4 projects out beyond the side walls 8 in the plug-in direction S. On the projecting section, the lower side 6 is provided with lugs 42 which can be bent around a protrusion 44 protruding in the height direction. As a result, the base plate 30 can be retained in a more stable manner in the socket housing 2. The protrusion 44 can have a depression 46 around which the lug 42 can be bent, so that the lug 42 is planked by the protrusion 44. Thus, a form-fit can be established in and counter to the plug-in direction S by the lug 42 and the base plate 30 can be connected to the socket as rigidly as possible in terms of movement.

That end of the base plate 30 is remotely positioned from the socket housing 2 and is, as depicted in FIG. 1, attached to a cable 48 with an electrical terminal 50, for example a cable lug, or an electrical conductor. For example, the base plate 30 can contain a crimp connection region in order to produce an electrical connection between the cable and the plug contact. The base plate can be introduced into the socket in the socket connector and in this case can project out of the socket at the end located to the rear in the plug-in direction, wherein the projecting part can be affixed indirectly or directly to a terminal or an electrical conductor. For example, the base plate 30 can also be welded to an electrical, conductive contact body.

In the shown embodiment, the base plate 30 includes an electrical terminal 49 which can be connected to the cable 48. The base plate 30 can, for example, be connected to the electrical conductor 50 in a materially bonded manner by welding. Electrical signals or electrical power can be transmitted to the plug contact 16 through the socket connector 1.

The base plate 30 is preferably formed from an electrically conductive material, in particular from copper or a copper alloy.

A first group of contact elements 32 is formed by a rigid, convexly curved contact body 52, on the peak 53 of which there is formed a contact surface 54 for contacting an electrically conductive contact 55, such as a plug contact 16, for example. The contact surfaces 54 of the contact bodies 52 point in the direction of the plug receiving opening 14. The contact bodies 52 can in particular be configured in a mechanically robust manner, so that the plug contact 16 can rest stably on the contact surface 54. The contact surfaces 54 of the contact bodies 52 in this case form a first contact plane 56 which is substantially parallel to a plane spanned by the plug-in direction S and transverse direction Q and which delimits the plug receiving opening 14 in the height direction H.

In order to obtain a statically determined system in a simple manner, the first contact plane 56 may be spanned by three contact surfaces 54 which are arranged in a triangle, wherein two contact surfaces are positioned in a row running in the transverse direction Q. When the plug contact 16 is plugged into the plug receiving opening 14, the plug contact 16 bias mainly on the contact surfaces 54 of the first contact plane 56. Therefore, the mechanical stability of a plug connector 15 according to the invention can be further improved by the statically determined system.

As shown, the contact surfaces 54 can be arranged in a triangle in order to create a statically determined contact plane in a simple manner. In particular, the first contact plane 56 can be spanned by three contact surfaces 54 since, from a mechanical point of view, the plug contact 16 bears mainly on the contact surfaces 54 of the first contact plane 56. At least of the first contact plane 56, the mechanical stability of the system can be further improved by the static nature of the contact surfaces 54. The contact surfaces 54 can be contacted uniformly, and the plug contact 16 can be prevented from swaying.

To compensate for tolerances and to improve the electrical and mechanical contacting of the plug contact 16, the contact assembly 3 and the socket connector 1 have a second contact plane 66 spaced apart from the first contact plane 56 and projecting beyond the first contact plane 56 in the height direction H, this second contact plane 66 being spanned by a plurality of contact surfaces 68 on contact bodies 70 that are elastically deflectable at least up to the first contact plane 56.

The elastically deflectable contact bodies 70 are formed by contact tongues 72, which extend from the base plate 30 in the height direction H and counter to the plug-in direction S up to a convexly curved free end 74. Each contact tongue 72 includes a peak 75 of which there are arranged the contact surfaces 68 of the second plane. The second contact plane 66 is likewise designed in a statically determined manner with three contact bodies 70 arranged in a triangle. The contact surfaces 68 of the second contact plane 66 can thus also be contacted uniformly by the plug contact 16.

The elastically deflectable contact bodies 70 of the second contact plane 66 can be formed by the contact tongues 72 that extend obliquely to the plug-in direction, towards a receptacle. In an exemplary embodiment, the contact tongues 72 can in this case be arranged at an angle between approximately 30° and 150° to the plug-in direction, wherein the contact tongues 72 are connected at one end to the base plate 30 and are convexly bent at the free end. The contact surface 68 can be formed at the free end of the contact tongue 72 and be arranged substantially parallel to the contact surface 54 of the first contact plane 56 and the plug-in direction. The contact tongues 72 can extend in the direction of a plug receiving opening 14 situated to the front in the plug-in direction.

In a particularly advantageous configuration, the contact tongues 72 can however extend in the direction away from the opening 14, such that the contact tongues 74 form a run-on slope along which the plug contact 16 can slide as the plug contact 16 is being plugged into the plug receiving opening 14 and in this case the contact tongues 72 push in the direction of the first contact plane 56.

The contact tongues 72 can taper toward the free end. The width transverse to the plug-in direction can decrease towards the free end, as a result of which a trapezoidal configuration of the contact tongues 72 arises and the distribution of stress in a contact tongue 72 is optimized.

In particular, the material thickness, particularly in the direction of the receptacle, of the contact tongues 72, can decrease towards the free end. This can improve the distribution of stress once again. Furthermore, this can lead to a stabilization in the contact surface. The density of the material at the free end can increase in this case, as a result of which the contact surface becomes mechanically more solid. The decrease in the material thickness can be produced by milling, for example.

As shown, the second contact plane 66 can likewise be spanned by three contact surfaces 68, as a result of which it can be ensured that the second contact plane 66 is likewise statically arranged in a simple manner. As a result, six contact surfaces are furthermore constantly in engagement with the plug contact 16, wherein the contact surfaces 54 of the first contact plane 56 span a contact plane which is fixed compared to the second contact plane 66 and the contact surfaces 68 of the second contact plane 66 span a flexible contact plane which is movable relative to the fixed contact plane. Both contact planes are statically determined, so that the plug contact can bear securely on all contact surfaces.

In an exemplary embodiment, as shown, the contact surfaces 68 of the second contact plane 66 can likewise be arranged in a triangle, with the triangle of the first contact plane 56 being arranged opposite the triangle of the second contact plane 66 and with them overlapping and the corners being formed in each case by a contact surface. In particular, one corner of the first triangle can be arranged on a base of the second triangle and conversely one corner of the second triangle can be arranged on a base of the first triangle. Through the arrangement in overlapping triangles, it is possible to achieve a particularly space-saving configuration of the contact assembly 3, wherein, in a first depth situated in the plug-in direction, two contact surfaces of one contact plane and one contact surface of the other contact plane are contacted and, in a second depth situated in the plug-in direction and spaced apart from the first depth, two contact surfaces of the other contact plane and one contact surface of the one contact plane are contacted.

In order to create a particularly contact assembly 3 and/or a socket connector 1 that is compact, it is particularly advantageous if a contact body 52 of the first contact plane 56 is arranged in a first row, arranged in the transverse direction Q, between two contact bodies 70 of the second contact plane 66, and a contact body of the second contact plane 66 between two contact bodies 52 of the first contact plane 56 is conversely arranged in a second row spaced apart from the first row in the plug-in direction S.

The contact tongues 72 taper in the direction of the free end 74, such that they have a trapezoidal tongue back 76. As a result, the stress distribution of the stress acting on the contact tongues 72 due to the elastic deflection can be improved. Furthermore a material thickness 78 decreases in the height direction H, as a result of which the distribution of stress is further improved and the solidity of the contact surface 68 can be further reinforced.

According to another configuration (not shown), the contact tongues 72 can also extend in the plug-in direction S and height direction H away from the base plate 30. As a result, the plug contact 16 can slide along the tongue back 76 during plugging-in and deflect the contact tongue 72 in the direction of the first contact plane 56.

The contact surfaces 54, 68 of the first and second contact planes 56, 66 are formed integrally as a monolithic component 80. For this purpose, the contact bodies 52, 70 can be formed by plastic deformation. For example, the contact bodies 52, 70 can be formed by stamping. A contact tongue 72 extends in each case into a contact receiving passageway 82 which passes through the base plate 30.

The contact surfaces 54, 68 are configured in an undulating, staggered manner, as a result of which the contacting of the plug contact 16 improves once again.

The contact planes 56, 66 are spaced apart from one another in the height direction H by the height 84, wherein the first contact plane 56 delimits the plug receiving opening 14 and the second contact plane 66 is arranged in the plug receiving opening 14.

The rigid contact bodies 52 of the first contact plane 56 can be rigid in particular compared to the contact bodies 70 of the second contact plane 66. The spring stiffness of the rigid contact bodies 52 can preferably be stiffer than the spring stiffness of the springs 10.

The spring strength of the springs 10 can in particular be stronger than the spring strength of the elastically deflectable contact bodies 70, so that the contact bodies 70 can be pushed in the direction of the first contact plane 56 when the plug contact 16 is being plugged into the plug receiving opening 14. In particular, a minimum normal force of the plug connector 15 can deflect the second contact plane 66 so far that the first and second contact planes 56, 66 are arranged in a common plane.

The socket has a press-on lug 90, which delimits the plug receiving opening 14 in the height direction H and which is spaced apart from the first contact plane 56, so that the plug receiving opening 14 extends in the height direction H from the first contact plane 56 to the press-on lug 90. The second contact plane 66 is arranged between the press-on lug 90 and the first contact plane 56, such that the press-on lug 90 pushes a plug contact 16 against the contact surfaces 68 of the second contact plane 66 and deflects the contact bodies 70 in the direction of the first contact plane 56 by the height 84, such that the contact surfaces 54, 68 are arranged on a common plane.

The elastically deflectable contact bodies 70 of the second contact plane 66 can thus compensate for a tolerance and provide additional electrically conductive contact surfaces 68, while the rigid contact bodies 52 of the first contact plane 56, alongside electrical contacting, serves the purpose of mechanical stabilization. From a mechanical point of view, the plug contact 16 bears mainly on the contact surfaces 54 of the first contact plane 56.

Therefore, through the socket connector 1 according to the invention, a mechanical and electrically stable contacting can be achieved with a plurality of contact surfaces 54, 68.

As a result of the aforementioned design, the number of electrically conductive contacted contact surfaces 54, 68 can be increased in a simple manner, wherein the elastically deflectable contact bodies 70 of the second contact plane 66 can compensate for tolerances. From a mechanical point of view, the plug contact 16 bears mainly on the contact surfaces 54 of the first contact plane 56, which makes the system mechanically more stable.

The foregoing illustrates some of the possibilities for practicing the invention. Many other embodiments are possible within the scope and spirit of the invention. The combination of features shown and described in the individual exemplary embodiments serves solely the purposes of explanation. The disclosed invention utilizes the above identified components, as a system, in order to more efficiently construct an electrical connector for a particular purpose. Therefore, more or less of the aforementioned components can be used to conform to that particular purpose. In addition, according to the above statements, a further feature can be added in an exemplary embodiment if its technical effect is meant to be advantageous or necessary for a particular application. It is, therefore, intended that the foregoing description be regarded as illustrative rather than limiting, and that the scope of the invention is given by the appended claims together with their full range of equivalents.

What is claimed is:

1. A contact assembly for an electrical connector, comprising:

a base plate;

a plurality of first contact bodies formed and extending from the base plate and having contact surfaces providing a first contact plane, the first contact plane spanned by at least three contact surfaces of the plurality of first contact bodies; and a plurality of second contact bodies formed and extending from the base plate and having contact surfaces and providing a second contact plane spaced apart from and projecting beyond the first contact plane by a height, the plurality of second contact bodies elastically deflectable to the first contact plane.

2. The contact assembly according to claim 1, wherein the plurality of first contact bodies are rigid compared to the plurality of second contact bodies.

3. The contact assembly according to claim 1, wherein the second contact plane is spanned by at least three contact surfaces of the plurality of second contact bodies.

4. The contact assembly according to claim 1, wherein the base plate is connected to an electrical conductor.

5. The contact assembly according to claim 1, wherein the plurality of first contact bodies are formed by plastic deformation of the base plate.

6. The contact assembly according to claim 5, wherein the plurality of second contact bodies are formed by plastic deformation of the base plate.

7. The contact assembly according to claim 1, wherein the contact surfaces of the plurality of first contact bodies are convexly curved.

8. The contact assembly according to claim 7, wherein the contact surfaces of the plurality of second contact bodies are convexly curved.

9. The contact assembly according to claim 8, wherein the plurality of second contact bodies are trapezoidal shaped members.

10. A socket connector for connection to a plug connector, comprising:

a socket having a plug receiving opening leading into a plug connector receiving space; and a contact assembly having a base plate adapted to the socket, the base plate having:

a plurality of first contact bodies extending into the plug connector receiving space and having contact surfaces providing a first contact plane; and a plurality of second contact bodies extending into the plug connector receiving space and having contact surfaces, the plurality of second contact bodies providing a second contact plane spaced apart from and projecting beyond the first contact plane by a height, the plurality of second contact bodies elastically deflectable to the first contact plane.

11. The socket connector according to claim 10, wherein the base plate is secured to the socket in a form-fitting manner.

12. The socket connector according to claim 11, wherein the plurality of second contact bodies include contact tongues extending obliquely to a plug-in direction.

13. The socket connector according to claim 12, wherein plurality of first contact bodies are rigid compared to the plurality of second contact bodies.

14. The socket connector according to claim 13, wherein the first contact plane is spanned by at least three contact surfaces of the plurality of first contact bodies.

15. The socket connector according to claim 13, wherein the contact surfaces of the plurality of first contact bodies and the plurality of second contact bodies are convexly curved.

16. The socket connector according to claim 13, wherein the plurality of second contact bodies are trapezoidal shaped members.

17. The socket connector according to claim 13, wherein the plurality of first contact bodies are formed by plastic deformation of the base plate.

18. The socket connector according to claim 17, wherein the plurality of second contact bodies are formed by plastic deformation of the base plate.

19. A contact assembly for an electrical connector, comprising:

a base plate;

a plurality of first contact bodies extending from the base plate and having contact surfaces providing a first contact plane, the plurality of first contact bodies arranged in a triangle and including a first contact body and a second contact body arranged in a first row extending in a transverse direction of the base plate and a third contact body arranged outside of the first row and between the first and second contact bodies in the transverse direction of the base plate; and a plurality of second contact bodies extending from the base plate and having contact surfaces and providing a second contact plane spaced apart from and projecting beyond the first contact plane by a height, the plurality of second contact bodies elastically deflectable to the first contact plane.

20. The contact assembly according to claim 19, wherein the plurality of first contact bodies and the plurality of second contact bodies are formed from the base plate.

21. The contact assembly according to claim 19, wherein the plurality of second contact bodies are arranged in a triangle and include a first contact body and a second contact body arranged in a second row extending in the transverse direction of the base plate and a third contact body arranged outside of the second row and between the first and second contact bodies of the plurality of second contact bodies in the transverse direction of the base plate.

* * * * *